US005288584A

United States Patent [19]

Yu

[11] Patent Number: 5,288,584

[45] Date of Patent: Feb. 22, 1994

[54] PROCESS FOR FABRICATING A FLEXIBLE ELECTROPHOTOGRAPHIC IMAGING MEMBER

[75] Inventor: Robert C. U. Yu, Webster, N.Y.

[73] Assignee: Xerox Corporation, Stamford, N.Y.

[21] Appl. No.: 82,010

[22] Filed: Jun. 18, 1993

Related U.S. Application Data

[63] Continuation of Ser. No. 812,392, Dec. 23, 1991, abandoned.

[51] Int. Cl.[5] ..... G03G 5/10; G03G 5/082

[52] U.S. Cl. ..... 430/128; 430/69

[58] Field of Search ..... 430/67, 69, 96, 128, 430/132

[56] References Cited

U.S. PATENT DOCUMENTS

| | | | |
|---|---|---|---|
| 4,265,990 | 5/1981 | Stolka et al. | 430/59 |
| 4,439,258 | 3/1984 | Toma et al. | 156/86 |
| 4,497,566 | 2/1985 | Ng | 355/3 CH |
| 4,587,189 | 5/1986 | Hor et al. | 430/59 |
| 4.728,577 | 3/1988 | Yamada et al. | 428/423.7 |
| 4,758,488 | 7/1988 | Johnson et al. | 430/59 |
| 4,760,008 | 7/1988 | Yamazaki et al. | 430/127 |
| 4,806,443 | 2/1989 | Yanus et al. | 430/56 |
| 4,925,760 | 5/1990 | Bararyi et al. | 430/59 |
| 5,004,649 | 4/1991 | Yamasaki et al. | 428/461 |
| 5,039,598 | 8/1991 | Abramsohn et al. | 430/347 |
| 5,089,369 | 2/1992 | Yu | 430/96 |

FOREIGN PATENT DOCUMENTS

| | | |
|---|---|---|
| 0203774 | 12/1986 | European Pat. Off. . |
| 0377318 | 7/1990 | European Pat. Off. . |
| 9117485 | 11/1991 | Netherlands . |

OTHER PUBLICATIONS

Patent Abstract of Japan, vol. 6, No. 229 (P-155)(1107) 16 Nov. 1982.

Patent Abstract of Japan, vol. 12, No. 224 (P-721)(3071) 25 Jun. 1988.

*Primary Examiner*—John Goodrow

[57] ABSTRACT

A process for fabricating a flexible electrophotographic imaging members including providing a flexible substrate including a biaxally oriented thermoplastic polymer web coated with at least one thermoplastic adhesive layer, vapor depositing on the adhesive layer a thin charge generating layer, cooling the charge generating layer to induce strain in the charge generating layer as well as at the interface between the charge generating layer and the substrate, heating the flexible substrate to shrink the biaxally oriented thermoplastic polymer web and substantially remove the strain from the charge generating layer, and forming a layer of a charge transport coating solution on the charge generating layer, the charge transport coating solution including a charge transporting film forming polymer matrix, and solvent for the film forming polymer matrix, and drying the charge transport coating solution.

14 Claims, No Drawings

PROCESS FOR FABRICATING A FLEXIBLE ELECTROPHOTOGRAPHIC IMAGING MEMBER

This is a continuation of application Ser. No. 07/812,392, filed Dec. 23, 1991, now abandoned.

BACKGROUND OF THE INVENTION

This invention relates in general to a fabrication process and more specifically, to a process for fabricating a flexible electrophotographic imaging member.

Flexible electrophotographic imaging member belts are usually multilayered photoreceptors that comprise a substrate, an electrically conductive layer, an optional hole blocking layer, an adhesive layer, a charge generating layer, and a charge transport layer and, in some embodiments, an anti-curl backing layer. One type of multilayered photoreceptor comprises a layer of finely divided particles of a photoconductive inorganic compound dispersed in an electrically insulating organic resin binder. U.S. Pat. No. 4,265,990 discloses a layered photoreceptor having separate charge generating (photogenerating) and charge transport layers. The charge generating layer is capable of photogenerating holes and injecting the photogenerated holes into the charge transport layer.

One of the more encouraging advances in electrophotographic imaging which has emerged in recent years is the successful fabrication of a of a flexible imaging member which exhibits a nearly ideal capacitive charging characteristic, outstanding photosensitivity, low electrical potential dark decay, and long term electrical cyclic stability. This imaging member design employed in belt form usually comprises a substrate, a conductive layer, solution coated hole blocking layer, a solution coated adhesive layer, a thin vapor deposited charge generating layer of pure organic pigment, a solution coated charge transport layer, a solution coated anti-curl layer, and an optional overcoating layer. For example, in U.S. Pat. No. 4,587,189 to Hor et al photoconductive imaging members are described comprising a vacuum sublimation deposited benzemidazole perylene charge generating layer for electrophotographic imaging members.

This multilayered belt imaging member provides excellent electrical properties and extended life, but is also observed to exhibit a major problem of forming cracks in the charge generating layer. Since these cracks have an appearance similar to cracks found in dried mud flats, they are often referred to as "mud cracks". These observed mud cracks in the charge generating layer are a two-dimensional network of cracks. Mud-cracking is believed to be the result of built-in internal strain due to the vacuum sublimation-deposition process and subsequent solvent penetration through the thin charge generating layer. The penetrating solvent dissolves the adhesive layer underneath the generating layer during application of the charge transport layer coating solution. Crack formation in the charge generating layer seriously impacts the versatility of a photoreceptor and reduces its practical value. Cracks in charge generating layers not only print out as defects in the final copy, but may act as strain concentration centers which propagate the cracks into the other electrically operative layer, i.e. the charge transport layer, during dynamic belt machine cycling.

While the above described imaging member exhibits desirable electrical characteristics, there is an urgent need to resolve the cracking issue in order to achieve an imaging member capable of forming high quality prints under extended image cycling conditions. It is also important that any solution employed to solve the charge generating layer mud-cracking problem does not produce any deleterious effects on the electrical and mechanical integrity of the original device.

Thus, there is a continuing need for an electrophotographic imaging member having improved resistance to mud crack formation in the charge generating layer.

INFORMATION DISCLOSURE STATEMENT

U.S. Pat. No. 5,039,598 to Abramsohn et al, issued Aug. 13, 1991—A process is disclosed for preparing an ionographic imaging member comprising the steps of: (1) providing a flexible, shrinkable tube containing a dielectric film forming polymer; and (2) providing a cylindrical support member having an outer diameter that is less than the inner diameter of the flexible tube. The tube may be shrunk to bring an inner surface of the tube and an outer surface of the cylindrical support member into intimate contact. The shrinkable tube may contain dissolved or dispersed materials in the dielectric thermoplastic film forming polymer. The dissolved or dispersed materials may include inorganic or organic materials such as metal oxide. The metal oxide may include aluminum oxide.

U.S. Pat. No. 4,728,577 to Yamada et al, issued Mar. 1, 1988—A magnetic recording medium is disclosed comprising a support which is shrinkable. A heat treatment process is used to shrink the support, e.g. see column 3, lines 19-38.

U.S. Pat. No. 4,439,258 to Toma et al, issued Mar. 27, 1984—A method is disclosed for covering a substrate with a cylindrically shaped heat shrinkable film. The method for covering the substrate is conducted by a heat treatment process.

U.S. Pat. No. 4,760,008 to Yamazaki et al, issued Jul. 26, 1988—A process for depositing a photosensitive layer by chemical vapor deposition is disclosed in which deposition is enhanced both by microwave and magnetic field. The microwave and the magnetic field cooperate in exciting a process gas. At first, the pressure in a resonating chamber is set at a low pressure in which electron cyclotron resonates. Next the pressure is increased to a level at which the process gas is excited in hybrid resonating action.

U.S. Pat. No. 4,925,760 to Baranyi et al, issued May 15, 1990—An improved layered photoresponsive imaging member is disclosed comprising a supporting substrate, a vacuum evaporated photogenerator layer comprised of certain pyranthrone pigments including tribromo-8,16-pyranthrenedione and trichloro-8,16-pyranthrenedione; and an aryl amine hole transport layer comprised of certain arylamine molecules dispersed in a resinous binder.

U.S. Pat. No. 4,758,488 to Johnson et al, issued Jul. 19, 1988—A photoresponsive imaging member is disclosed comprised of a supporting substrate, a photogenerating layer, and a hole transporting layer comprised of a polysilylene stabilized with a component possessing an ionization potential equal to or greater than the polysilylene.

U.S. Pat. No. 4,806,443 to Yanus et al, issued Feb. 21, 1989—An electrostatographic imaging member and an electrophotographic imaging process for using the imaging member are disclosed in which the imaging member comprises a substrate and an electroconductive layer, the imaging member comprising a specific polymeric acrylamine compound. The imaging member may comprise a substrate, charge generation layer and a charge transport layer.

In copending U.S. application Ser. No. 07/545,831 filed on Jun. 29, 1990, in the name of Robert Yu, a process is described for avoiding mud crack formation of a vapor deposited charge generation layer by utilizing an adhesive layer that is not soluble in the solvent employed to deposit the charge transport layer. The entire disclosure of the application is incorporated herein by reference.

SUMMARY OF THE INVENTION

It is, therefore, an object of the present invention to provide an improved electrophotographic imaging member which overcomes the above-noted deficiencies.

It is yet another object of the present invention to provide an improved electrophotographic imaging member which resists the formation of cracks in vapor deposited charge generating layers.

It is still another object of the present invention to provide an improved electrophotographic imaging member which exhibits greater resistance to layer delamination.

It is another object of the present invention to provide an improved electrophotographic imaging member which provides excellent electrical properties.

It is yet another object of the present invention to provide an improved electrophotographic imaging member which gives extend photoelectrical service life.

It is also an object of the present invention to provide an improved electrophotographic imaging member which overcomes the problems of the prior art.

The foregoing objects and others are accomplished in accordance with this invention by providing a process for fabricating a flexible electrophotographic imaging member comprising providing a flexible substrate comprising a biaxally oriented thermoplastic polymer web coated with at least one thermoplastic adhesive layer, vapor depositing on the adhesive layer a thin charge generating layer, cooling the charge generating layer to induce strain in the charge generating layer as well as at the interface between the charge generating layer and the substrate, heating the flexible substrate to shrink the biaxally oriented thermoplastic polymer web and substantially remove the strain from the charge generating layer, and forming a layer of a charge transport coating solution on the charge generating layer, the charge transport coating solution comprising a charge transporting film forming polymer matrix, and solvent for the film forming polymer matrix, and drying the charge transport coating solution.

The origin of the problem associated with the observed mud-cracking involves the buildup of internal tensile strain in the charge generating layer as a result of vapor deposition (e.g. sublimation) of this layer onto an adhesive layer in a multilayered imaging device. In particular, during the vapor deposition process, the organic pigment evaporates at a high temperature from a crucible and condenses onto a flexible substrate comprising a thermoplastic polymer web coated with at least one thermoplastic adhesive layer. Usually, the thermoplastic polymer web coated with at least one thermoplastic adhesive layer contains an adhesive, a charge blocking layer, an electrically conductive layer and a thermoplastic supporting web which may also have an anticurl layer on its back side. The thin charge generating layer comprises about 0.65 percent of the flexible supporting substrate thickness. During this vapor deposition process, the condensed charge generating layer remains at an elevated temperature and at a stress/strain free state. However, the temperature rise in the substrate during the charge generating layer deposition step is only slight because it has a much larger mass than the charge generating layer and also because it is a good heat insulator. A typical mass ratio between the charge generating layer and the substrate is about 1 to 152. As the layers cool to ambient room temperature, two-dimensional thermal contraction of the charge generating layer exceeds that of the substrate, and causes the development of internal strain in the charge generating layer.

Adhesives commonly used in the adhesive layer are highly soluble in methylene chloride, which is a common solvent for applying the charge transport layer coating solution. Although the vapor deposited charge generating layer is insoluble in the solvent used to apply the charge transport layer, it is permeable to solvents used to apply the charge transport layer because it is very thin. This permeability allows the solvent to penetrate through the thin charge generating layer during the charge transport layer coating step. It has been found that penetration of solvent through the charge generating layer is uneven and can adversely affect the charge generating layer/adhesive layer interface bonding due to irregular dissolution of the adhesive layer. Without the adhesive layer serving as a support anchor, the vapor deposited charge generating layer releases its planar internal strain in an irregular pattern, resulting in two-dimensional mud-cracking.

Electrophotographic flexible belt imaging members are well known in the art. These electrophotographic flexible belt imaging member may be prepared by various suitable techniques. Typically, a flexible substrate is provided having an electrically conductive surface. For electrophotographic imaging members, at least one photoconductive layer is then applied to the electrically conductive surface. A charge blocking layer may be applied to the electrically conductive layer prior to the application of the photoconductive layer. An adhesive layer is utilized between the charge blocking layer and the photoconductive layer. For multilayered photoreceptors, a charge generation layer is usually applied onto the blocking layer and charge transport layer is then formed on the charge generation layer.

The substrate may be opaque or substantially transparent and may comprise numerous suitable materials having the required mechanical properties. Accordingly, the substrate may comprise a layer of an electrically non-conductive or conductive material comprising a major component of a biaxially oriented thermoplastic polymer. As electrically non-conducting materials there may be employed various resins known for this purpose including thermoplastic polyesters, polypropylene, polyimides, polyamides, polyurethanes, and the like which are flexible and biaxially oriented as thin webs. The electrically insulating or conductive substrate should be flexible and in the form of an endless flexible belt. Preferably, the endless flexible belt shaped substrate comprises a commercially available biaxially oriented polyester known as Mylar TM, available from E I du Pont de Nemours & Co., Melinex TM available from ICI, or Hostaphan TM, available from American Hoechst. The expression "biaxially oriented" as employed herein is defined as a property imparted to an extruded web by a manufacturing process involving extensive stretching of the web in both the longitudinal and transverse directions after its emergence from the extrusion die. The purpose of the biaxial stretching of the web is to force the polymer molecules in the material matrix to align and orient themselves in both the longitudinal and transverse directions to improve the two-dimensional mechanical properties and strength of the web. This biaxial orientation process is followed immediately by a heat setting step at high temperature to induce the development of microcrystallinity in the web for enhancement of thermal stability as well as elevation of the working temperature of the web. In a typical process employed for the manufacturing of a biaxially oriented webs, a web of polyethylene terephthalate is subjected to biaxial stretching of about 300 to 400 percent elongation followed by a heat setting temperature of about 190° C.

The thickness of the substrate layer depends on numerous factors, including beam strength and economical considerations, and thus this layer for a flexible belt may be of substantial thickness, for example, about 175 micrometers, or of minimum thickness of about 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers.

The electrically conductive ground layer may be an electrically conductive metal layer which may be formed, for example, on the flexible biaxially oriented substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is preferably between about 20 Angstroms and about 750 Angstroms, and more preferably between about 50 Angstroms and about 200 Angstroms for an optimum combination of electrical conductivity, flexibility and light transmission.

Regardless of the technique employed to form the metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a transparent copper iodide (CuI), or a conductive carbon black dispersed in a plastic binder as an opaque conductive layer.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino) titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. No. 4,338,387, U.S. Pat. No. 4,286,033 and U.S. Pat. No. 4,291,110. A preferred hole blocking layer comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a charge generating layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like.

An adhesive layer is applied to the hole blocking layer. Any suitable solvent soluble thermoplastic adhesive layer well known in the art may be utilized. Typical adhesive layer materials include, for example, polyesters, duPont 49,000 (available from E.I. duPont de Nemours and Company), Vitel PE-100 (available from Goodyear Tire & Rubber), polyurethanes, and the like and mixtures thereof. Typical mixtures include, for example, blends of poly(4,4'-dipropylidene-diphenylene carbonate) with a polyester (Vitel PE-100), blends of polycarbonate (Makrolon) with a polyester (Vitel PE- 200), blends of 4,4'-cyclohexylidene diphenyl polycarbonate with polyester, and the like. These adhesive materials are soluble in the same solvent utilized to apply the charge transport layer materials. Satisfactory results may be achieved with adhesive layer thickness between about 0.05 micrometer (500 angstroms) and about 0.3 micrometer (3,000 angstroms). Conventional techniques for applying the adhesive layer coating mixture to the charge blocking layer include, for example, spraying, dip coating, roll coating, wire wound rod coating, gravure coating, Bird applicator coating, and the like. Drying of the deposited coating may be effected by any suitable conventional technique such as oven drying, infrared radiation drying, air drying and the like. If desired, the adhesive layer may comprise a plurality of layers, the upper adhesive layer being soluble in the same solvent utilized to apply the charge transport layer materials. Typical dual layers comprise poly(4,4'-dipropylidene-diphenylene carbonate) overcoated with polyester (49000), 4,4'-cyclohexylidene diphenyl polycarbonate overcoated with polyester (PE-200) and the like.

Any suitable continuous, thin vapor deposited photogenerating layer may be applied to the adhesive blocking layer which can then be overcoated with a contiguous hole transport layer as described hereinafter. Examples of materials out of which photogenerating layers can be vapor deposited include photoconductive perylene and phthalocyanine pigments, for example, benzimidazole perylene and chloroindium phthalocyanine. Other phthalocyanine pigments such as the X-form of metal free phthalocyanine described in U.S. Pat. No. 3,357,989, and metal phthalocyanines in the forms of vanadyl phthalocyanine, titanyl phthalocyanine and copper phthalocyanine are also included. Other pigments of interest include, for example, dibromoanthanthrone; squarylium; quinacridones such as those available from du Pont under the tradename Monastral Red, Monastral Violet and Monastral Red Y; dibromo anthanthrone pigments such as those available under the trade names Vat Orange 1 and Vat Orange 3; substituted 2,4-diamino-triazines disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like. Multi-photogenerating layer compositions may be utilized where a photoconductive layer enhances or reduces the properties of the photogenerating layer. Other suitable photogenerating materials known in the art and which can be vapor deposited may also be utilized, if desired. Charge generating layers comprising a photoconductive material such as vanadyl phthalocyanine, metal free phthalocyanine, benzimidazole perylene, and the like and mixtures thereof are especially preferred because of their sensitivity to white light. However, chloroindium phthalocyanine, vanadyl phthalocyanine, and metal free phthalocyanine are also preferred because these materials provide the additional benefit of being sensitive to infrared light.

The charge generating layer may be applied by any suitable vapor deposition process. Use of a vapor deposition process such as vacuum sublimation-deposition process is well known in the art and is especially desirable to obtain a thin charge generating layer without the need of a polymer binder. Generally, the charge generating material is heated to a temperature sufficient to vaporize it. A vacuum may be utilized to facillitate vaporization and, depending upon the material utilized, prevent decomposition. The substrate to be coated is maintained at a temperature below the condensation temperature of the charge generating material vapors. A typical technique for vapor deposition of charge generating layers is disclosed, for example, in U.S. Pat. No. 4,587,189, the entire disclosure thereof being incorporated herein by reference. Thin sublimation deposited charge generating layers are desirable because they permit intimate pigment-to-pigment contact and provide a shorter charge carrier traveling path to reach the charge transport layer for efficient electrophotographic imaging process enhancement. Charge generating layers which contain 50 percent by volume pigment dispersed in a binder as described, for example, in U.S. Pat. No. 3,121,006, need to be twice as thick as a sublimation deposited one. However, permeability to solvents is more apparent with the thin vapor deposited charge generating layers which, though insoluble in the solvents, are adversely affected by solvent destruction of the interfacial bonding between the adhesive layer and charge generating layer, leading to the release of planar internal strain in the charge generating layer, thereby resulting in mud-cracking of the charge generating layer. The charge generating layer containing the vacuum deposited photoconductive composition generally ranges in thickness of from about 0.1 micrometer to about 5 micrometers, and preferably has a thickness of from about 0.2 micrometer to about 3 micrometers. However, an optimum thickness between about 0.3 and about 1 micrometer gives best results. Thicknesses outside these ranges can be selected providing the objectives of the present invention are achieved.

Since charge generator layers are formed by heat vaporization of a vaporizable organic photoconductive material onto a flexible web substrate, the hot deposited layer contracts upon cooling. Since the substrate has a mass of approximately 160 times greater than the mass of the deposited charge generating layer, the temperature of the substrate remains below the condensation temperature of the vaporized pigment thereby facillitating condensation of the vaporized organic photoconductive material. The hot, freshly deposited charge generator layer then contracts as it cools to ambient room temperature whereas the substrate is already cool and, therefore, does not undergo any significant cooling or dimensional contraction changes. This difference in dimensional contraction between the charge generating layer and the substrate creates internal strain to buildup in the charge generating layer as well as at the interface between the charge generating layer and the underlying substrate. If a charge transport layer comprising charge transport small molecule and film forming binder dissolved in a solvent is applied to the charge generating layer, the solvent penetrates the thin charge generating layer and dissolves the underlying solvent soluble adhesive layer. Since penetration of the thin charge generating layer by the solvent occurs at an uneven rate, the dissolving of the adhesive layer occurs unevenly which in turn releases the internal strain unevenly thereby causing random cracking (e.g. mud crack appearance) to occur in the charge generating layer.

In the process of this invention, the biaxially oriented polymeric web coated with the conductive layer, blocking layer, adhesive layer and charge generating layer is heated to shrink the biaxially oriented web prior to the application of a charge transport layer. The shrinking of the biaxially oriented web when heated is preferably accomplished below the working temperature of the web material to maximize retention of the other mechanical properties of the web. The expression "working temperature" as employed herein is defined as a temperature which does not cause more than about 1 percent mechanical and dimensional degradation of a web material, e.g. 155° C. for the polyethylene teraphthalate web. Mechanical and dimensional degradations of a web material can readily be determined by standard tests which measure Young's modulus, percent elongation at break, break stress, and the like. Working temperatures are usually provided by the manufacturers of biaxially oriented polymeric webs. For example, heat shrinking treatment of a polyethylene terephthalate web, when carried out below the 155° C. working temperature recommended by the manufacturer, causes slight dimensional reduction in the film, in both the longitudinal and transverse directions, without significantly affecting the film's mechanical integrity. This property is described, for example by M. F. Vallat and D. J. Plazek, Effects of Thermal Treatment on Biaxially Oriented Polyethylene Terephthalate II. The Anisotropic Glass Temperature, J. of Polym. Sci., Part B: Polym. Phys. Vol. 26, 545–554, 1988. The amount of shrinkage for any given biaxially oriented polymeric web material may be determined experimentally by heating the web at an elevated temperature (preferably below the working temperature) and measuring and plotting dimensional contractions as a function of time. When tested for mechanical properties, test web samples heat shrunk at elevated temperatures below the working temperature give values of Young's modulus, break elongation, and break stress equivalent to or less than a 1 percent difference with respect to those obtained for a virgin control sample, indicating that the mechanical integrity of the web is maintained after being subjected to the heat treatment process. From the experimental values obtained, calculations can be made to determine the optimum temperature and time of heating desired for substantially removing or eliminating the internal strain from the charge generating layer as well as from the interface between the charge generating layer and the underlying substrate to a value of less than about 0.08 percent. It has also been experimentally demonstrated that at a fixed temperature, shrinkage in polyethylene terephthalate depends on the time of heat treatment. Conversely, by using the time-temperature relationship, the achievement of a specific degree of substrate shrinkage can be accelerated, i.e., can be obtained in a shorter time, by simply increasing the heat treatment temperature. Heating may be effected by any suitable means. Typical heating processes include, for example, oven heating, forced air heating, infrared heating, microwave heating, and the like.

The charge transport layer may comprise any suitable solvent soluble organic polymer or non-polymeric material capable of supporting the injection of photogenerated holes and electrons from the charge generating layer and allowing the transport of these holes or electrons through the charge transport layer to selectively discharge the surface charge. The charge transport layer not only serves to transport holes or electrons, but also protects the photoconductive layer from abrasion or chemical attack and therefore extends the operating life of the photoconductive imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It comprises a substantially nonphotoconductive material which supports the injection of photogenerated holes from the charge generating layer. The charge transport layer is normally transparent when exposure is effected therethrough to ensure that most of the incident radiation is utilized by the underlying charge-generating layer. When used with a transparent substrate, imagewise exposure or erase may be accomplished through the substrate with all light passing through the substrate. In this case, the charge transport layer material need not transmit light in the wavelength region of use. The charge transport layer in conjunction with the charge generating layer is an insulator to the extent that an electrostatic charge placed on the charge transport layer is not conducted in the absence of illumination.

The active charge transport layer may comprise activating compounds useful as an additive dispersed in electrically inactive polymeric materials making these materials electrically active. These compounds may be added to solvent soluble polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductive imaging member of this invention comprises from about 25 percent to about 75 percent by weight of at least one charge transporting aromatic amine compound, and about 75 percent to about 25 percent by weight of a polymeric film forming resin in which the aromatic amine is soluble. Aromatic amine compounds for charge transport layers are well known in the art. Typical aromatic amine compounds for charge transport layers include, for example, triphenylmethane, bis(4-diethylamine-2-methylphenyl)phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(-3''-methylphenyl)-(1,1'-biphenyl)-4,4'-diamine, and the like dispersed in an inactive resin binder. Charge transport Any suitable inactive resin binder soluble in methylene chloride or other suitable solvents may be employed in the process of this invention even though the solvent used for charge transport layer coating solution can attack by the adhesive layer underlying the charge generating layer. Typical inactive resin binders soluble in methylene chloride include polycarbonate resin, polyester, polyarylate, polyacrylate, polyether, polysulfone, and the like. Molecular weights can vary from about 20,000 to about 1,500,000. Other solvents that may dissolve these charge transport layer binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan TM 145 from General Electric Company; poly(4,4'-isopropylidene-diphenylene carbonate) with a molecular weight of from about 40,000 to about 45,000, available as Lexan TM 141 from General Electric Company; a polycarbonate resin having a molecular weight of from about 50,000 to about 100,000, available as Makrolon TM, from Farbenfabricken Bayer A. G.; a polycarbonate resin having a molecular weight of from about 20,000 to about 50,000, available as Merlon TM from Mobay Chemical Company; polyether carbonates; and 4,4'-cyclohexylidene diphenyl polycarbonate. Methylene chloride is the preferred solvent for most charge transport layer coating solutions because it adequately dissolves all the coating material components and because it has a low boiling point which enhances wet coating drying after application over the charge generating layer. The adhesive layer material underlying the charge generating layer is soluble in and subject to attack by the charge transport coating composition solvent (e.g. methylene chloride) during application of the charge transport layer coating composition. Still other inactive resin binders soluble in methylene chloride or other suitable solvent may be employed in the process of this invention. Additional typical inactive resin binders soluble in methylene chloride include polyvinylcarbazole, polyester, polyarylate, polyacrylate, polyether, polysulfone, and the like. Molecular weights can vary from about 20,000 to about 150,000.

If desired, a charge transport layer may comprise electrically active resin materials instead of charge transporting compounds with inactive resin materials. Electrically active resin materials are well known in the art. Typical electrically active resin materials include, for example, polymeric arylamine compounds and related polymers described in U.S. Pat. Nos. 4,801,517, 4,806,444, 4,818,650, 4,806,443 and 5,030,532. Polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. The disclosures of each of the patents identified above pertaining to binders having charge transport capabilities are incorporated herein by reference in their entirety.

The thickness of the charge transport layer may be between about 10 micrometers and about 50 micrometers, and preferably from about 20 micrometers to about 35 micrometers, but thicknesses outside this range can also be used. Optimum thicknesses is between about 23 micrometers and about 31 micrometers.

Any suitable and conventional technique may be utilized to mix and thereafter apply the charge transport layer coating mixture to the charge generating layer. Typical application techniques include spraying, dip coating, roll coating, wire wound rod coating, and the like. The charge transport layer is applied to the charge generating layer after the substrate carrying the charge generating layer has been cooled. Drying of the deposited coating may be effected by any suitable conventional technique such as oven drying, infra red radiation drying, air drying and the like.

Examples of photosensitive members having at least two electrically operative layers include the charge generator layer and diamine containing transport layer members are disclosed, for example, in U.S. Pat. Nos. 4,265,990, 4,233,384, 4,306,008, 4,299,897 and 4,439,507. The disclosures of these patents are incorporated herein in their entirety.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side of the supporting substrate opposite the electrically active layers of the photoreceptor to provide flatness. These overcoatings and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284 the entire disclosure of this patent being incorporated herein by reference.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A photoconductive imaging member was prepared by providing a web of titanium coated biaxially oriented polyethylene terephthalate substrate (Melinex, available from ICI Americas Inc.) substrate having a thickness of 3 mils, and applying thereto, with a gravure applicator using a production coater, a solution containing 50 grams 3-aminopropyltriethoxysilane, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 0.05 micrometer.

An adhesive interface layer was then prepared by the applying a wet coating over the blocking layer, using a gravure applicator, containing 0.5 percent by weight based on the total weight of the solution of copolyester adhesive (du Pont 49,000, available from E. I. du Pont de Nemours & Co.) in a 70:30 volume ratio mixture of tetrahydrofuran/cyclohexanone. The adhesive interface layer was then dried for about 5 minutes at 135° C. in the forced air drier of the coater. The resulting adhesive interface layer had a dry thickness of 620 Angstroms.

A 0.7 micrometer thickness benzimidazole perylene charge generating pigment was vacuum sublimation deposited over the du Pont 49,000 adhesive layer from a heated crucible at a web speed of 6 feet per minute. The sublimation-deposition process was carried out in a vacuum chamber under about $4\times10^{-5}$ mm Hg pressure and a crucible temperature of about 550° C. During vapor deposition, the deposited benzimidazole perylene layer was at an elevated temperature whereas the adhesive coated substrate, being a good heat insulator and having a large mass compared to the deposited benzimidazole perylene, exhibited little or negligible temperature rise and remained essentially at low temperature. This benzimidazole perylene coated member was removed from the vacuum chamber and as it was cooled to ambient room temperature strain in the deposited benzimidazole perylene charge generating layer began to build up due to dimensional thermal contraction of the deposited benzimidazole perylene charge generating layer.

A 9 inch×12 inch sample was then cut from the web, and the benzimidazole perylene charge generating layer was overcoated with a charge transport layer. The charge transport layer coating solution was prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecule weight of about 120,000 and commercially available from Farbenfabricken Bayer A. G. The resulting mixture was dissolved by adding methylene chloride to the glass bottle to form a 16 percent weight solid charge transport layer solution. This solution was applied onto the charge generating layer by hand coating using a 3 mil gap Bird applicator to form a wet coating which upon drying at 135° C. in an air circulation oven for 5 minutes gave a dried charge transport layer thickness of 24 micrometers. During the charge transport layer coating process, the humidity was controlled at or less than 15 percent.

Although the benzimidazole perylene charge generating layer is insoluble in methylene chloride (the solvent used for applying the charge transport layer coating solution), the application of the charge transport layer coating solution to the benzimidazole perylene charge generating layer allowed the solvent to penetrate through the thin charge generating layer to the adhesive layer beneath and caused dissolution of the adhesive layer. Without the anchor support of a solid adhesive layer, uneven planar contraction due to the built-in internal strain within the benzimidazole perylene charge generating layer resulted in the formation of mud-cracks in the benzimidazole perylene charge generating layer. The mud-cracks were visible to the naked eye and also under 50× magnification using both reflection and transmission optical microscopes.

After application of the charge transport layer coating, the imaging member spontaneous curled upwardly. An anti-curl coating was needed to impart the desired flatness to the imaging member. The anti-curl coating solution was prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle was then covered tightly and placed on a roll mill for about 24 hours until total dissolution of the polycarbonate and the copolyester is achieved. The anti-curl coating solution thus obtained was applied to the rear surface of the supporting substrate (the side opposite to the imaging layers) by hand coating using a 3 mil gap Bird applicator. The coated wet film was dried at 135° C. in an air circulation oven for about 5 minutes to produce a dry, 14 micrometer thick anti-curl layer. The resulting photoconductive imaging member was flat.

EXAMPLE II

To demonstrate that the observed benzimidazole perylene charge generating layer mud-cracking was due to the effect of internal tension strain release in the benzimidazole perylene charge generating layer as a result of solvent permeation to and dissolution of the adhesive layer rather than due to the effect of differential thermal contraction between the charge transport layer and the supporting substrate during the heating, drying and cooling processes, a piece of test sample of the adhesive coated polyethylene terephthalate substrate bearing the benzimidazole perylene charge generating layer described in Example I was tested for direct methylene chloride exposure without any application of a charge transport layer. Instantaneous mud-cracking in the benzimidazole perylene charge generating layer was immediately visible, under a 100× magnification using a reflection optical microscope, as soon as a drop of methylene chloride was applied directly onto the charge generating layer of the test sample.

EXAMPLE III

Another piece of the test sample of the adhesive coated polyethylene terephthalate substrate bearing only the benzimidazole perylene charge generating layer described in Example I was heat treated at 135° C. for one minute to cause two-dimensional shrinking in the substrate in order to reduce the built-in internal strain from the benzimidazole perylene charge generating layer. The heat treatment process of one minute at 135° C. was determined to represent a linear dimensional shrinkage of only 0.21 percent in the polyethylene terephthalate substrate.

After applying the charge transport layer and anti-curl layer to complete fabrication of the photoconductive imaging member as described in Example I, a fine pattern of mud-cracking was visible in the benzimidazole perylene charge generating layer only when the sample was examined under 200× magnification, using both a reflection and a transmission optical microscope. This demonstrates the partial effectiveness of the time used for the heat treatment process in preventing the formation of mud-cracks in the benzimidazole perylene charge generating layer.

EXAMPLE IV

Another piece of the test sample of the adhesive coated polyethylene terephthalate substrate bearing only the benzimidazole perylene charge generating layer described in Example I was heat treated at 135° C. for 2 minutes to cause a two-dimensional shrinking in the substrate in order to reduce the built-in internal strain from the benzimidazole perylene charge generating layer to less than about 0.08 percent.

The two minute heat treatment process at 135° C. was determined to represent a linear dimensional shrinkage of 0.29 percent in the substrate. Compared to the dimensional shrinkage result of Example III, an increase in the heat treatment time by another minute produced an additional 0.08 percent in linear dimensional contraction of the substrate. This additional dimensional contraction was determined to be critical in resolving the charge generating layer mud-cracking problem.

After applying the charge transport layer and anti-curl layer to complete fabrication of the photoconductive imaging member as described in Example I, no mud-cracking was evident in the benzimidazole perylene charge generating layer when the sample was carefully examined under 200× magnification, using both a reflection and a transmission optical microscope. This result demonstrates the effectiveness of the process of the present invention in total removal of the internal strain from the sublimation deposited charge generating layer, thereby eliminating the mud-cracking problem from the charge generating layer when the critical substrate dimensional shrinkage was achieved.

EXAMPLE V

Another piece of the test sample was prepared using the same procedure and material as described in Example IV, except that the time of heat treatment was extended to four minutes and the total linear dimensional shrinkage in the substrate was determined to be 0.45 percent.

After completion of the fabrication of the photoconductive imaging member, the benzimidazole perylene charge generator was observed to be free of mud-cracking.

EXAMPLE VI

The photoconductive imaging members of Control Example I and Example V (invention) were evaluated for adhesion properties using a 180° peel test method.

The 180° peel strength is determined by cutting a minimum of five 0.5 inch×6 inches imaging member samples from each of Examples I and V. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape. At this condition, the anti-curl layer/substrate of the stripped segment of the test sample can easily be peeled away 180° from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer with the substrate by the width of the test sample. The crack-free photoconductive imaging member of this invention gave a significantly higher average peel strength of 8.9 gm/cm than the average value of 6.0 gm/cm obtained for the control imaging member counterpart. The adhesion improvement seen in the imaging member of this invention is an attribute due to the elimination of the internal strain from the charge generating layer.

EXAMPLE VII

The photoconductive imaging member fabricated using the present concept of this invention as described in Examples IV and V along with the control imaging member of Example I were examined for their electrophotographic performances using a xerographic scanner at 21° C. and 40 percent relative humidity. The results obtained, after 50,000 cycles of testing, of charge acceptance, dark decay potential, background and residual voltages, photosensitivity, photo-induced discharge characteristics, and long term electrical cyclic stability, for all the imaging member of this invention were equivalent to those obtained for the control imaging member of Example I, indicating that the photoelectrical integrity of the original photoconductive imaging member had been maintained.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for fabricating a flexible electrophotographic imaging member comprising providing a flexible substrate comprising a biaxially oriented thermoplastic polymer supporting web coated with at least one adhesive layer comprising a thermoplastic adhesive, vapor depositing on said adhesive layer a thin charge generating layer, cooling said charge generating layer to induce strain between said charge generating layer and said substrate, heating said flexible substrate to shrink said biaxially oriented thermoplastic polymer web and substantially remove said strain between said charge generating layer and said substrate, forming a layer of a charge transport coating solution on said charge generating layer, said charge transport coating solution comprising a charge transporting film forming polymer matrix and solvent for said film forming polymer matrix, said solvent also being a solvent for said thermoplastic adhesive, and drying said charge transport coating solution.

2. A process for fabricating a flexible electrophotographic imaging member according to claim 1 wherein said biaxially oriented thermoplastic polymer web has a thickness between about 50 micrometers and about 200 micrometers.

3. A process for fabricating a flexible electrophotographic imaging member according to claim 2 wherein said biaxially oriented thermoplastic polymer web is polyethylene terephthalate.

4. A process for fabricating a flexible electrophotographic imaging member according to claim 1 wherein said charge generating layer has a thickness between about 0.1 micrometer and about 5 micrometers.

5. A process for fabricating a flexible electrophotographic imaging member according to claim 1 wherein said charge generating layer has a thickness between about 0.2 micrometer and about 3 micrometers.

6. A process for fabricating a flexible electrophotographic imaging member according to claim 1 wherein said charge generating layer has a thickness between about 0.3 micrometer and about 1 micrometer.

7. A process for fabricating a flexible electrophotographic imaging member according to claim 1 wherein said charge generating layer comprises benzimidazole perylene.

8. A process for fabricating a flexible electrophotographic imaging member according to claim 1 wherein said charge generating layer comprises a metal free phthalocyanine.

9. A process for fabricating a flexible electrophotographic imaging member according to claim 1 wherein said charge generating layer comprises a metal phthalocyanine.

10. A process for fabricating a flexible electrophotographic imaging member according to claim 9 wherein said charge generating layer comprises titanyl phthalocyanine.

11. A process for fabricating a flexible electrophotographic imaging member according to claim 1 including heating said flexible substrate to shrink said biaxially oriented thermoplastic polymer web until said strain remaining in said charge generating layer is less than about 0.08 percent.

12. A process for fabricating a flexible electrophotographic imaging member according to claim 1 wherein said charge transporting film forming polymer matrix comprises an electrically active charge transporting polymer.

13. A process for fabricating a flexible electrophotographic imaging member according to claim 1 wherein said charge transporting film forming polymer matrix comprises an electrically inactive polymer and at least one charge transporting aromatic amine compound.

14. A process for fabricating a flexible electrophotographic imaging member according to claim 1 wherein said heating of said flexible substrate to shrink said biaxially oriented thermoplastic polymer web and substantially remove said strain between said charge generating layer and said substrate is conducted at a temperature below the working temperature of said biaxially oriented thermoplastic polymer web.

* * * * *